US009082365B2

(12) United States Patent
Yoon

(10) Patent No.: US 9,082,365 B2
(45) Date of Patent: Jul. 14, 2015

(54) LIQUID CRYSTAL DISPLAY DEVICE AND DRIVING METHOD OF THE SAME IMPROVING AFTERIMAGE PROBLEM DUE TO IMAGE DATA OF BLACK LEVEL

(75) Inventor: Joon-Shik Yoon, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 191 days.

(21) Appl. No.: 13/281,119

(22) Filed: Oct. 25, 2011

(65) Prior Publication Data

US 2012/0098818 A1 Apr. 26, 2012

(30) Foreign Application Priority Data

Oct. 26, 2010 (KR) ..... 10-2010-0104675

(51) Int. Cl.

*G09G 5/10* (2006.01)
*G09G 3/36* (2006.01)
*G09G 3/20* (2006.01)

(52) U.S. Cl.

CPC ..... *G09G 3/3696* (2013.01); *G09G 3/2007* (2013.01); *G09G 3/3685* (2013.01); *G09G 2320/0238* (2013.01); *G09G 2320/0257* (2013.01); *G09G 2320/046* (2013.01)

(58) Field of Classification Search

CPC ..... G09G 5/10
USPC ..... 345/212, 87, 211, 690
See application file for complete search history.

(56) References Cited

U.S. PATENT DOCUMENTS

| | | | | |
|---|---|---|---|---|
| 7,317,442 | B2 * | 1/2008 | Nakai et al. | 345/100 |
| 7,460,191 | B2 * | 12/2008 | Song | 349/48 |
| 7,839,369 | B2 | 11/2010 | Chang et al. | |
| 2002/0060656 | A1 * | 5/2002 | Okuzono | 345/88 |
| 2007/0070012 | A1 * | 3/2007 | Chung | 345/92 |
| 2007/0188430 | A1 | 8/2007 | Moon | |
| 2008/0024420 | A1 | 1/2008 | Nakai et al. | |
| 2009/0219307 | A1 | 9/2009 | Yaguma et al. | |
| 2011/0090447 | A1 * | 4/2011 | You et al. | 349/139 |
| 2011/0298833 | A1 * | 12/2011 | Dorjgotov et al. | 345/690 |

FOREIGN PATENT DOCUMENTS

| | | | |
|---|---|---|---|
| CN | 1530918 | A | 9/2004 |
| EP | 1465147 | A2 | 10/2004 |
| JP | 3-260622 | A | 11/1991 |
| JP | 2002-99254 | A | 4/2002 |
| JP | 2003-242166 | A | 8/2003 |
| JP | 2006-106663 | A | 4/2006 |
| KR | 10-2004-0080364 | A | 9/2004 |
| KR | 10-2007-0081806 | A | 8/2007 |
| TW | 535135 | B | 6/2003 |

* cited by examiner

*Primary Examiner* — Pegeman Karimi
(74) *Attorney, Agent, or Firm* — Birch, Stewart, Kolasch & Birch, LLP

(57) ABSTRACT

A liquid crystal display device includes a liquid crystal panel; a gamma voltage supplying unit establishing a gamma voltage corresponding to each gray level according to a predetermined T-V curve; and a data driving unit changing digital image data into analog image data using the gamma voltage and outputting the analog image data to the liquid crystal panel, wherein the gamma voltage corresponding to a black level is configured to have a value within a range of 0 V to 0.005 V.

6 Claims, 4 Drawing Sheets

LIQUID CRYSTAL DISPLAY DEVICE AND DRIVING METHOD OF THE SAME IMPROVING AFTERIMAGE PROBLEM DUE TO IMAGE DATA OF BLACK LEVEL

This application claims the priority benefit of Korean Patent Application No. 10-2010-0104675, filed on Oct. 26, 2010, which is hereby incorporated by reference in its entirety.

BACKGROUND OF THE INVENTION

1. Field of the Invention

The present invention relates to a liquid crystal display device, and more particularly, to a liquid crystal display device and a driving method of the same.

2. Discussion of the Related Art

With rapid development of information technologies, display devices processing and displaying a large amount of information have been rapidly developed. Recently, flat panel display (FPD) devices such as a liquid crystal display (LCD) device, a plasma display panel (PDP) device and an organic light emitting diode (OLED) device have been suggested.

Among the various FPD devices, the LCD device has been widely used for its superiorities of small size, light-weight, thin profile and low power consumption. Meanwhile, active matrix type liquid crystal display devices, which include pixels arranged in a matrix form and thin film transistors to control on/off the respective pixels, have been widely used because of their high resolution, color rendering capability and superiority in displaying moving images.

Recently, in an LCD device for mobile devices, an image data of a black level of a gray scale has been widely used, and its displaying time has been increased. Thus, there is a problem of an afterimage at the black level in addition to afterimages at middle levels or low levels.

The afterimage at the black level will be explained with reference to Table 1. Table 1 shows a driving voltage at each level of a gray scale in a normally black mode.

In Table 1, the driving voltage of the black level Gray0, which is a zeroth gray level, is 0.222V, and this is for a gray scale inversion. More particularly, brightness at the levels of the gray scale should be gradually increased. At this time, the driving voltage of the black level Gray0 is lower than a voltage at which a gray inversion occurs, and the driving voltage of a first gray level Gray1 is higher than the voltage at which the gray inversion occurs. The driving voltages of second and third gray levels Gray2 and Gray3 are gradually increased. Here, the gray inversion may occur at about 0.3V, and the driving voltage of the first gray level Gray1 may be about 0.4V.

TABLE 1

| Gray | driving voltage (V) |
|---|---|
| 0 | 0.222 |
| 1 | 0.367 |
| 2 | 0.421 |
| 3 | 0.476 |
| 4 | 0.512 |
| 5 | 0.555 |
| 6 | 0.599 |
| 7 | 0.642 |
| 8 | 0.686 |
| 9 | 0.729 |
| 10 | 0.791 |

However, as stated above, when the driving voltage of the black level Gray0 is about 0.2V and the image data of the black level Gray0 is displayed for a long time, liquid crystal is affected by 0.2V. Therefore, the image data of the black level displayed at a current frame remains at a next frame, and there is an afterimage.

SUMMARY OF THE INVENTION

Accordingly, the present invention is directed to a liquid crystal display device and a driving method of the same that substantially obviate one or more of the problems due to limitations and disadvantages of the related art.

An object of the present invention is to provide a liquid crystal display device and a driving method of the same that improve an afterimage problem due to an image data of a black level.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal panel; a gamma voltage supplying unit establishing a gamma voltage corresponding to each gray level according to a predetermined T-V curve; and a data driving unit changing digital image data into analog image data using the gamma voltage and outputting the analog image data to the liquid crystal panel, wherein the gamma voltage corresponding to a black level is configured to have a value within a range of 0 V to 0.005 V.

In another aspect, a driving method of a liquid crystal display device includes changing digital image data into analog image data; and outputting the analog image data to a liquid crystal panel, wherein outputting the analog image data to the liquid crystal panel includes using a gamma voltage established according to a predetermined T-V curve, wherein the gamma voltage corresponding to a black level is configured to have a value within a range of 0 V to 0.005 V.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Reference will now be made in detail to embodiments of the present invention, examples of which are illustrated in the accompanying drawings.

Figure 1:
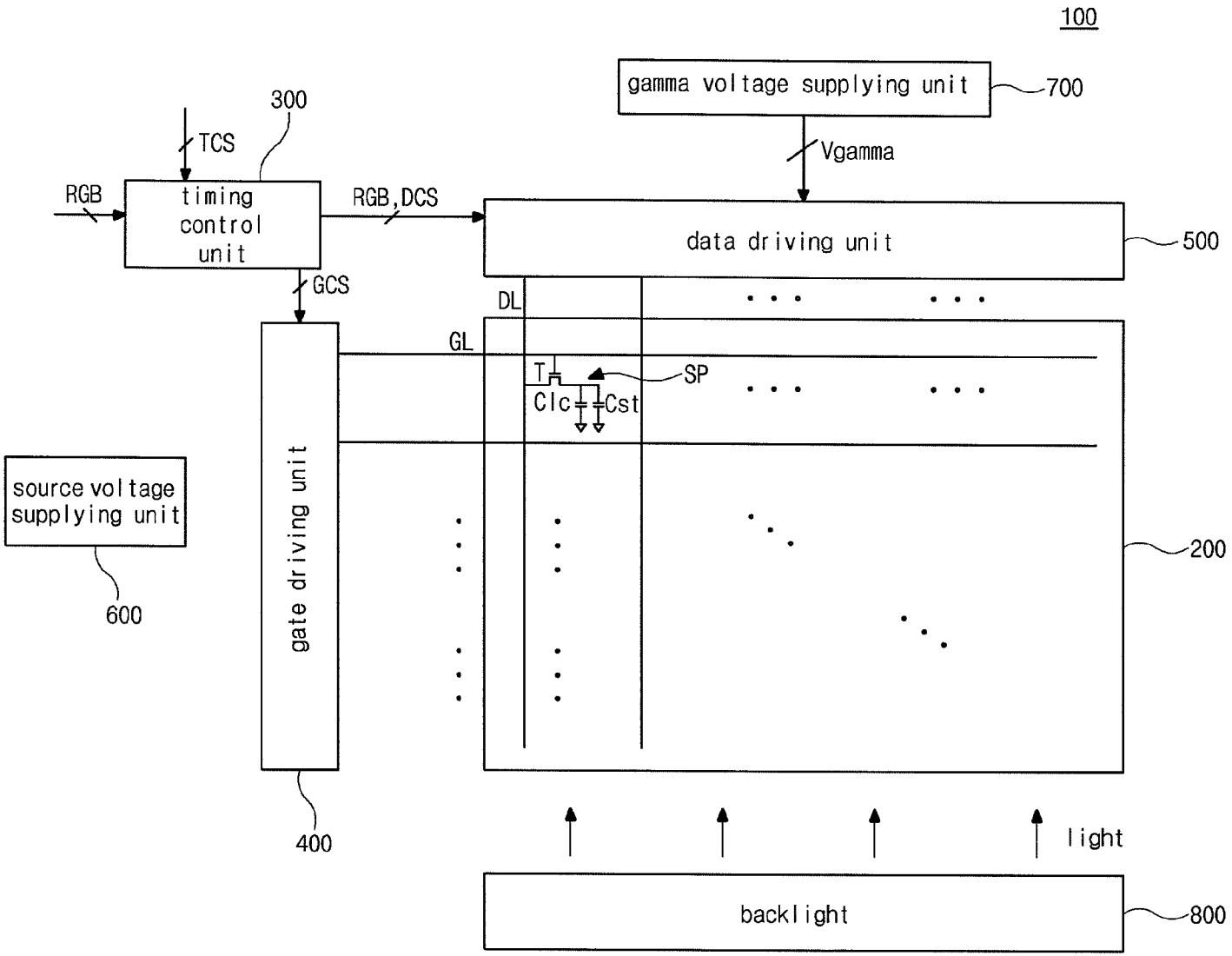
FIG. 1 is a schematic view of illustrating a liquid crystal display device according to an exemplary embodiment of the present invention.

FIG. 1 is a schematic view of illustrating a liquid crystal display device according to an exemplary embodiment of the present invention.

In FIG. 1, a liquid crystal display device 100 of the present invention includes a liquid crystal panel 200, a backlight 800 and a driving circuit portion.

The liquid crystal panel 200 includes gate lines GL extending along a row line direction and data lines DL along a column line direction in the context of the figure. The gate lines GL and the data lines DL cross each other to define subpixels SP arranged in a matrix form.

The subpixels SP, for example, may include R subpixels for red, G subpixels for green, and B subpixels for blue. R, G and B image data are inputted to R, G and B subpixels, respectively. Here, adjacent three R, G and B subpixels SP form a pixel.

Each subpixel includes a thin film transistor T, a liquid crystal capacitor Clc, and a storage capacitor Cst. The liquid crystal capacitor Clc comprises a pixel electrode and a common electrode. The thin film transistor T is formed at each crossing portion of the gate lines GL and the data lines DL and is connected to the pixel electrode.

A data voltage is applied to the pixel electrode, and a common electrode is applied to the common electrode. An electric field is generated between the pixel electrode and the common electrode, and liquid crystal molecules are driven by the electric field. The pixel electrode, the common electrode, and the liquid crystal molecules therebetween constitute the liquid crystal capacitor Clc.

In the meantime, the storage capacitor Cst in each subpixel SP stores the data voltage applied to the pixel electrode until a next frame.

The backlight 800 provides light to the liquid crystal panel 200. The backlight 800 may include a cold cathode fluorescent lamp (CCFL), an external electrode fluorescent lamp (EEFL) or a light emitting diode (LED) lamp as a light source.

The driving circuit portion includes a timing control unit 300, a gate driving unit 400, a data driving unit 500, a source voltage supplying unit 600, and a gamma voltage supplying unit 700.

The timing control unit 300 receives digital image data RGB and control signals TCS such as a vertical sync signal, a horizontal sync signal, a clock signal, a data enable signal from an outer system such as a TV system or a graphic card. Although not shown in the figure, the signals may be inputted through an interface constructed in the timing control unit 300.

The timing control unit 300 generates gate control signals GCS for controlling the gate driving unit 400 and data control signals DCS for controlling the data driving unit 500 by using the inputted control signals TCS. The gate control signals GCS include a gate start pulse (GSP), a gate shift clock (GSC), and a gate output enable (GOE). The data control signals include a source start pulse (SSP), a source sampling clock (SSC), a source output enable (SOE), and a polarity (POL).

The gate start pulse is a signal of indicating a start line of the liquid crystal panel 200 in a vertical period. The gate shift clock is a signal of determining on/off time of a gate of the thin film transistor. The gate output enable is a signal of controlling output of the gate driving unit 400.

The source sampling clock is used as sampling clock for latching data in the data driving unit 500 and determines a driving frequency of the data driving unit 500. The source output enable transmits the data latched by the source sampling clock to the liquid crystal panel 200. The source start pulse is a signal of indicating start of data latch or sampling in a horizontal period. The polarity is a signal of indicating a polarity for an inversion operation of liquid crystal.

The timing control unit 300 arranges the inputted digital image data RGB and provides them to the data driving unit 500.

The gate driving unit 400 scans the gate lines GL in order, corresponding to the gate control signals GCS provided by the timing control unit 300. For example, the gate driving unit 400 sequentially selects the gate lines GL during each frame and outputs a gate voltage to the selected gate line GL. The thin film transistors T of a corresponding row line are turned on by the gate voltage. Then, a turn-off voltage is applied to the gate line GL, and the thin film transistors T maintain a turn-off state.

The data driving unit 500 changes the digital image data RGB into analog image data RGB, corresponding to the data control signal DCS and the digital image data RGB provided by the timing control unit 300 and provide the analog image data RGB to the data lines DL. That is, the data driving unit 500 generates a data voltages corresponding to the digital image data RGB by using a gamma voltage Vgamma and outputs the data voltages to the data lines DL.

The source voltage supplying unit 600 receives reference voltages from the outer system and generates and provides voltages for elements of the liquid crystal panel 200 and the driving circuit portion. For example, the source voltage supplying unit 600 generates a power voltage supplied to the timing control unit 300, the gate driving unit 400 and the data driving unit 500 and also generates a gate high voltage and a gate low voltage supplied to the gate driving unit 400.

The gamma voltage supplying unit 700 generates a gamma voltage Vgamma for changing the digital image data RGB into the analog image data RGB and provides the gamma voltage Vgamma to the data driving unit 500.

The gamma voltage driving unit 700 will be explained in more detail with reference to accompanying drawings.

The gamma voltage Vgamma is supplied to the pixel electrode of the liquid crystal display device 100 and is applied to the liquid crystal layer. The transmittance of the liquid crystal display device 100 changes depending on the gamma voltage Vgamma, and the gray scale is produced.

The gamma is a slope of showing a relation between input and output of a converter. The gamma shows the relation between transmittances of the digital image data RGB and the analog image data RGB in the liquid crystal display device 100. It is known that optimum viewing angle and brightness properties can be achieved at the gamma of about 2.2 when the visibility of the viewer is considered.

Meanwhile, the gamma voltage can be expressed by a gamma curve, which shows the relation between the digital image data RGB and the analog image data RGB.

Figure 2:
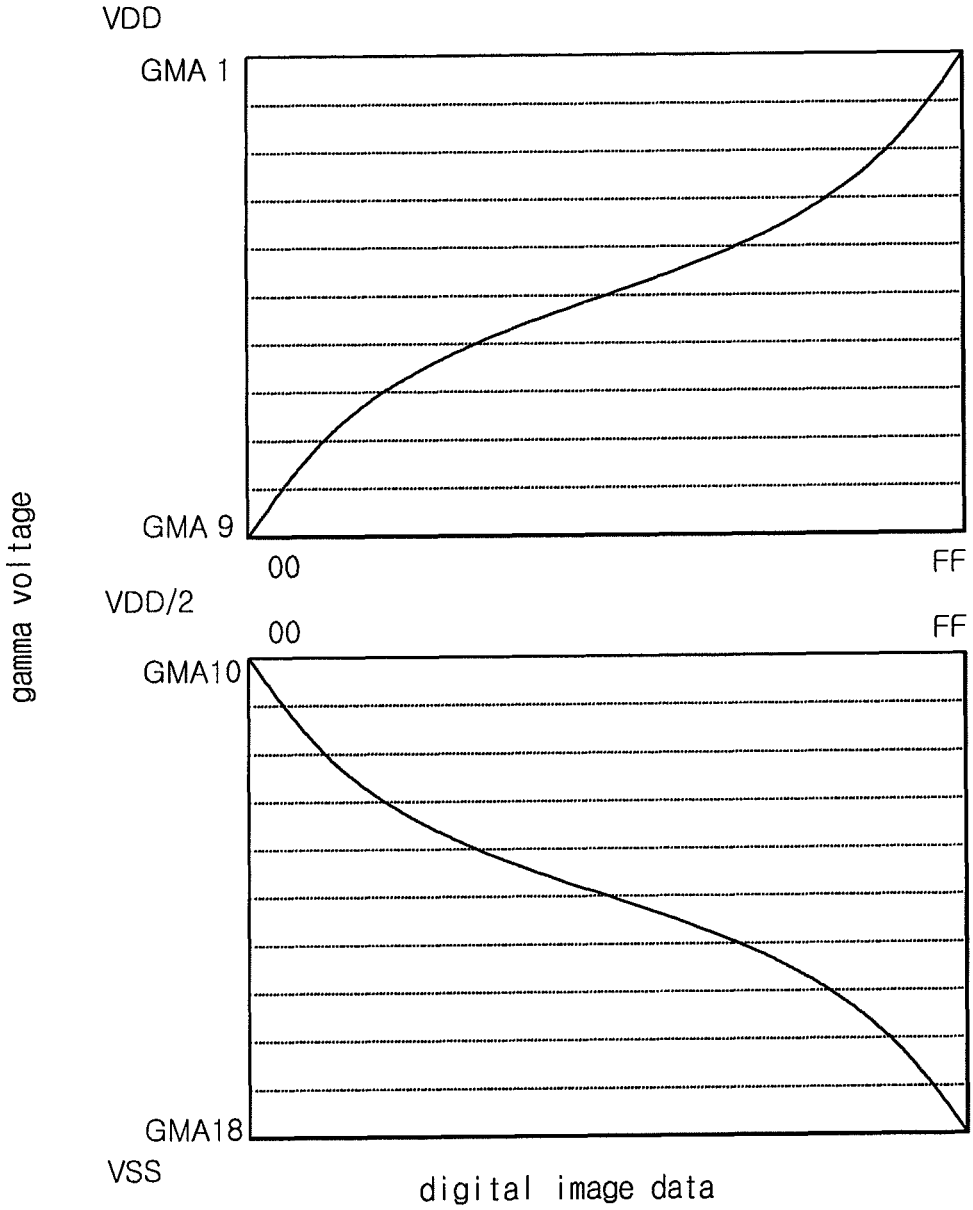
FIG. 2 is a graph of illustrating a gamma curve of a normally black mode liquid crystal display device according to the present invention.

FIG. 2 is a graph of illustrating a gamma curve of a normally black mode liquid crystal display device according to the present invention. FIG. 2 shows a change of the gamma voltage Vgamma depending on the digital image data RGB.

In FIG. 2, when the digital image data RGB is 8-bit data, which is expressed by hexadecimal (base 16) code HEX, for example, the gamma voltage Vgamma for the analog image data can be divided into 256 gray levels. Namely, the data driving unit 500 of the liquid crystal display device 100 decodes the digital image data RGB and selects and provides the gamma voltage Vgamma corresponding to the decoded information to the pixel electrode, thereby displaying an image of 256 gray levels.

Here, the gamma voltage Vgamma has a value between a high potential source voltage VDD and a low potential source voltage VSS, and some of the gamma voltage Vgamma corresponds to a plurality of gamma reference voltages GMA1 to GMA18.

The gamma voltage Vgamma is generated due to voltage division, in which the high potential source voltage VDD and the low potential source voltage VSS are connected a plurality of resistors in series therebetween and a voltage between the high potential source voltage VDD and the low potential source voltage VSS is divided by the resistors. This will be explained hereinafter with reference to FIG. 3.

Figure 3:
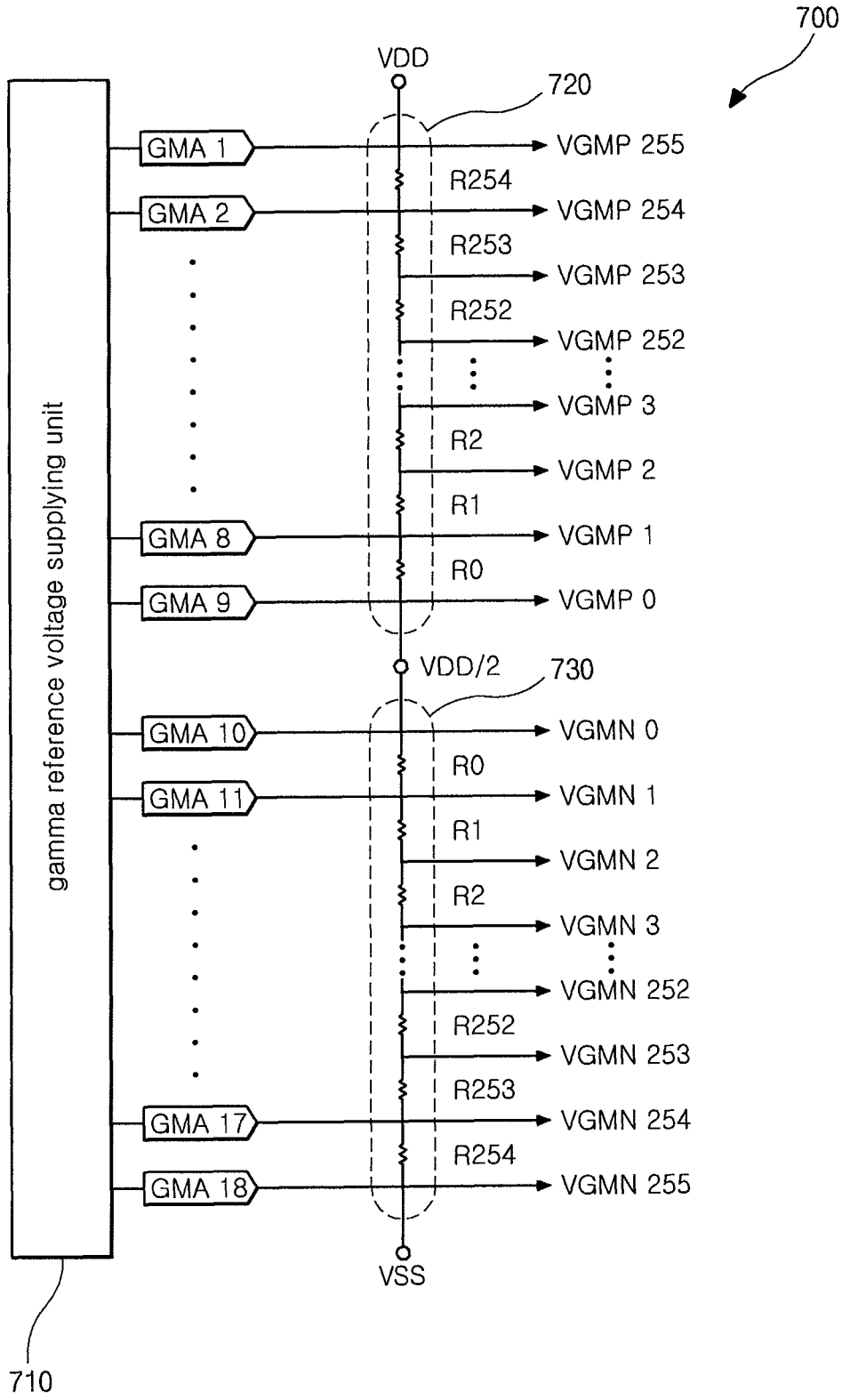
FIG. 3 is a view of illustrating a gamma voltage supplying unit according to an embodiment of the present invention.

FIG. 3 is a view of illustrating a gamma voltage supplying unit according to an embodiment of the present invention.

In FIG. 3, the gamma voltage supplying unit 700 includes a gamma reference voltage supplying part 710, a positive gamma voltage generating part 720, and a negative gamma voltage generating part 730.

The gamma reference voltage supplying part 710 generates a plurality of gamma reference voltages GMA1 to GMA18 and provides them to nodes between resistors R0 to R254 of each of the positive gamma voltage generating part 720 and the negative gamma voltage generating part 730.

When the gamma voltage Vgamma is generated simply due to the voltage division using the resistors R0 to R254, there may be current leakage along with the outputted gamma voltage Vgamma, and currents flowing through the resistors R0 to R254 may be decreased. Therefore, the gamma voltage Vgamma may not be correctly outputted as designed. At this time, using the gamma reference voltages GMA1 to GMA18, decreases in the currents may be compensated, and a predetermined gamma voltage Vgamma may be outputted. That is, the gamma reference voltages GMA1 to GMA18 function as a sort of a current source.

The positive gamma voltage generating part 720 includes the plurality of resistors R0 to R254 in series between the high potential source voltage VDD and a half voltage VDD/2 of the high potential source voltage VDD. The positive gamma voltage generating part 720 divides a voltage between both ends of the plurality of resistors R0 to R254 due to a voltage division rule and generates and outputs positive gamma voltage values VGMP0 to VGMP255. Here, the high potential source voltage VDD may be a fixed voltage that is generated in the source voltage supplying unit 600 of the liquid crystal display device 100. A resistance of each of the resistors R0 and R254 may be 3% of a total resistance of the resistors R1 to R253. For example, each of the resistors R0 and R254 may have a resistance of about 420 ohms when the total resistance of the resistors R1 to R253 may be about 14K ohms.

Similarly, the negative gamma voltage generating part 730 includes the plurality of resistors R0 to R254 in series between the half voltage VDD/2 of the high potential source voltage VDD and the low potential source voltage VSS. The negative gamma voltage generating part 730 divides a voltage between both ends of the plurality of resistors R0 to R254 due to the voltage division rule and generates and outputs negative gamma voltage values VGMN0 to VGMN255.

The positive gamma voltage values VGMP0 to VGMP255 and the negative gamma voltage values VGMN0 to VGMN255 are determined depending to the resistances of the resistors R0 to R254 and are designed considering transmittance-voltage (T-V) characteristics of the liquid crystal display device 100 and the visibility of the viewer.

The gamma voltage Vgamma outputted from the gamma voltage supplying unit 700 is applied to the pixel electrode of the liquid crystal display device 100, thereby displaying an image. The transmittance-voltage characteristics of the liquid crystal display device 100 may be changed depending on its designs or deviations in manufacturing processes. That is, the liquid crystal display device 100 may be designed to have different transmittance-voltage characteristics for its usage or model from others. In addition, even in the same model, the liquid crystal display device 100 may have different transmittance-voltage characteristics from others due to deviations in photolithography processes for patterns such as the pixel electrode in manufacturing processes or deviations in a cell gap.

A design of the gamma voltage considering transmittance-voltage characteristics will be explained hereinafter with reference to FIG. 4.

Figure 4:
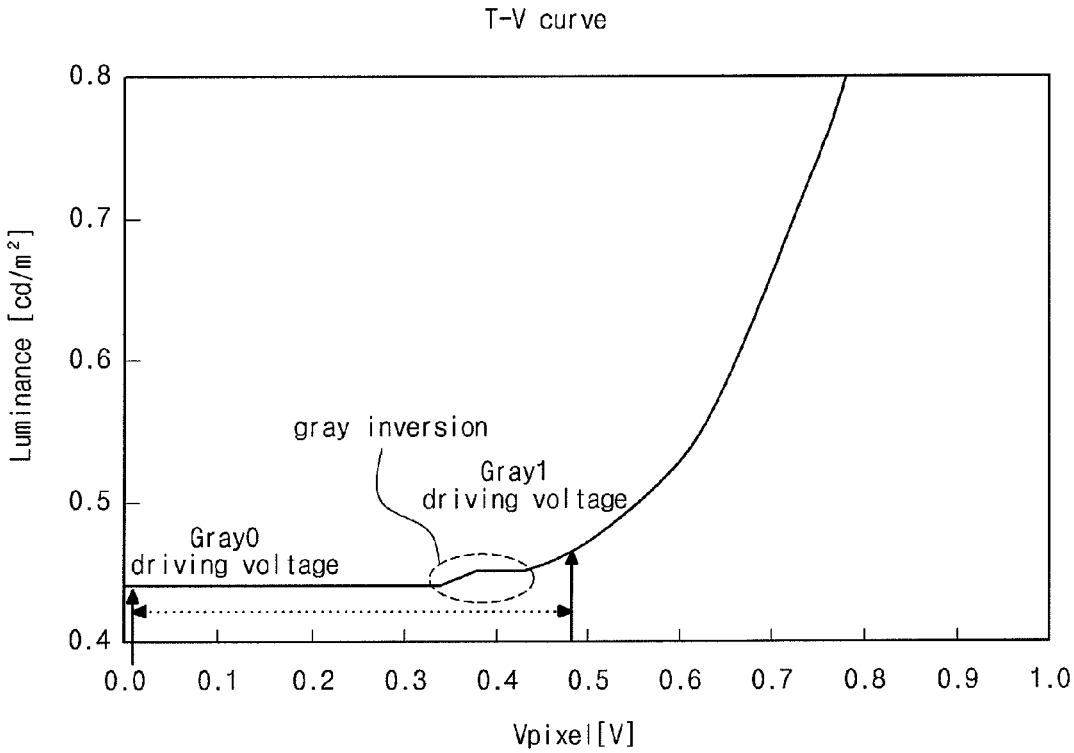
FIG. 4 is a graph of illustrating transmittance-voltage characteristics of a liquid crystal display device according to the present invention.

FIG. 4 is a graph of illustrating transmittance-voltage characteristics of a liquid crystal display device according to the present invention. FIG. 4 shows variations of luminance versus voltage, which is applied to the pixel electrode of the normally black mode liquid crystal display device 100 and is referred to as a pixel voltage Vpixel. For convenience of explanation, the graph of FIG. 4 will be referred to as a T-V curve.

The T-V curve of FIG. 4 shows the variations of luminance when the pixel voltage Vpixel is less than 1 V. Namely, the T-V curve corresponds to low gray levels.

In FIG. 4, when the pixel voltage Vpixel is less than about 0.35 V, the luminance hardly changes and has a substantially constant value.

When the pixel voltage Vpixel is more than 0.45 V, the luminance increases. More particularly, an instant variation of the luminance to the pixel voltage Vpixel gradually increases, and the luminance rapidly increases. This is to consider that human beings easily distinguish a brightness difference in a dart image but hardly distinguish a brightness difference in a bright image.

When the pixel voltage Vpixel is more than about 0.35 V and less than about 0.45 V, there is a gray inversion that the luminance increases and then decreases. This is why upper and lower sections of the liquid crystal panel have asymmetric arrangements due to movements of the liquid crystal molecules when a voltage is applied to the liquid crystal layer. Namely, according to the voltage applied to the liquid crystal layer, the luminance does not increase because of different phase retardation effects due to properties of the liquid crystal molecules and temporarily decreases.

Hereinafter, a driving voltage corresponding to a zeroth gray level Gray0 of the present invention will be described with reference to Table 2.

Table 2 shows gray levels corresponding to the T-V curve of FIG. 4 and corresponding driving voltages. Here, a black level is the zeroth gray level Gray0, and a white level is a $255^{th}$ gray level Gray255.

TABLE 2

| Gray | driving voltage (V) |
|---|---|
| 0 | 0.005 |
| 1 | 0.483 |
| 2 | 0.523 |
| 3 | 0.602 |
| 4 | 0.642 |
| 5 | 0.667 |
| 6 | 0.692 |
| 7 | 0.717 |

TABLE 2-continued

| Gray | driving voltage (V) |
|---|---|
| 8 | 0.742 |
| 9 | 0.766 |
| 10 | 0.791 |

In the present invention, the driving voltage corresponding to the black level Gray0, that is, the value of the gamma voltage Vgamma, is designed to have a value of about 0 V. For example, as shown in Table 2, the driving voltage of the black level Gray0 may be 0.005 V or may be less than or more than 0.005 V. Therefore, the driving voltage of the black level Gray0 may be with a range 0 V to 0.005 V.

Namely, the driving voltage of the black level Gray0 has a value within a range in which an afterimage of the image data of the black level does not exist after the image data of the black level is displayed in the liquid crystal panel 200. As stated above, this will be flexibly determined considering the characteristics of the T-V curve.

The driving voltage corresponding to the first gray level Gray1, that is, the value of the gamma voltage Vgamma, is designed to have a value as largely different as possible from the driving voltage corresponding to the black level Gray0. In addition, the driving voltage of the first gray level Gray1 may have a value within a range in which the luminance gradually increases after the gray inversion occurs.

More particularly, the driving voltage of the first gray level Gray1 may be more than about 0.4V, at which the gray inversion does not occur. Moreover, the driving voltage of the first gray level Gray1 may be more than about 0.45V, where the luminance gradually increases. For example, the driving voltage of the first gray level Gray1 may be 0.483 V as shown in Table 2 or may be more or less than this.

Namely, as mentioned above, since the gray inversion occurs from about 0.35 V to about 0.45 V, the driving voltage of the first gray level Gray1 may be determined more than a voltage at which the gray inversion does not occur. Additionally, the driving voltage of the first gray level Gray1 may be determined more than a voltage from which the luminance increases, for example, 0.45 V such than the luminance at each level is gradually raised.

When the driving voltage of the black level Gray0 is about 0 V, there is no afterimage after the image data of the black level is displayed in the liquid crystal panel. This is because the liquid crystal layer is not affected by the driving voltage of the black level Gray0. Thus, clearer quality of images can be displayed. Moreover, since the driving voltage of the black level Gray is relatively low, there is an effect of reducing power consumption. Furthermore, when the driving voltage of the first gray level Gray1 is designed as stated above, the gray inversion does not occur.

Therefore, the gray inversion can be prevented, and the afterimage of the black level can be improved.

Meanwhile, as mentioned above, the T-V curve can be changed due to the design of the liquid crystal display device 100 or the deviations in the manufacturing processes. That is, the liquid crystal display device 100 can be designed to have different T-V characteristics from others depending on its model or usage. Thus, the driving voltages of the black level Gray0 and the first gray level Gray1 can be changed depending on the corresponding T-V curve.

In the liquid crystal display device of the present invention, the afterimage of the image data of the black level is improved. Since the driving voltage of the black level is about 0 V, the power consumption is improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel;

a gamma voltage supplying unit configured to establish a gamma voltage corresponding to each gray level according to a predetermined T-V curve; and a data driving unit configured to change digital image data into analog image data using the gamma voltage and output the analog image data to the liquid crystal panel, wherein the gamma voltage corresponding to a black level is configured to have a value within a range of 0 V to 0.005 V, and wherein the gamma voltage corresponding to a first gray level that is a next level to the black level is configured to have a value within a range in which luminance increases after a gray inversion that the luminance increases and then decreases between 0.35V of a pixel voltage and 0.45V of the pixel voltage in the predetermined T-V curve as the pixel voltage continuously increases, and the gray inversion occurs between the black level and the first gray level.

2. The liquid crystal display device according to claim 1, wherein the gamma voltage supplying unit includes:

a positive gamma voltage generating part connected to a high potential source voltage and a half voltage of the high potential source voltage and configured to output positive gamma voltage values; and a negative gamma voltage generating part connected to the half voltage of the high potential source voltage and a low potential source voltage and configured to output negative gamma voltage values.

3. The liquid crystal display device according to claim 2, wherein each of the positive and negative gamma voltage generating parts includes a plurality of resistors R0 to R254 in series, and wherein a resistance of each of the resistors R0 and R254 is 3% of a total resistance of the resistors R1 to R253.

4. The liquid crystal display device according to claim 1, further comprising:

a gate driving unit configured to scan gate lines of the liquid crystal panel; and a timing control unit configured to provide the digital image data and data control signals to the data driving unit and provide gate control signals to the gate driving unit.

5. A driving method of a liquid crystal display device, the driving method comprising:

changing digital image data into analog image data; and outputting the analog image data to a liquid crystal panel, wherein outputting the analog image data to the liquid crystal panel includes using a gamma voltage established according to a predetermined T-V curve, wherein the gamma voltage corresponding to a black level is configured to have a value within a range of 0 V to 0.005 V, and wherein the gamma voltage corresponding to a first gray level that is a next level to the black level is configured to have a value within a range in which luminance increases after a gray inversion that the luminance increases and then decreases between 0.35V of a pixel voltage and 0.45V of the pixel voltage in the predetermined T-V curve as the pixel voltage continuously increases, and the gray inversion occurs between the black level and the first gray level.

6. An apparatus comprising:

a data driver component configured to provide outputs to a display panel using gamma voltages to produce gray-scale characteristics for images displayed via the display panel; and a positive gamma voltage supply portion and a negative gamma voltage supply portion that are operatively connected with and separate from the data driver component, and the positive gamma voltage supply portion and a negative gamma voltage supply portion are configured to supply thereto the gamma voltages by using a zeroth gray level (Gray0) driving voltage that is within a range of 0V to 0.005V and by setting a first gray level (Gray1) driving voltage to be a value that is greater than 0.4V, wherein gray inversion occurs within a range of about 0.35V to about 0.45V, whereby use of the gamma voltages supplied from the positive gamma voltage supply portion and the negative gamma voltage supply portion results in suppression of afterimages and reduced power consumption when supplying gamma voltages that use a zeroth gray level (Gray0) driving voltage that is within a range of 0V to 0.005V, set a first gray level (Gray1) driving voltage to be a value that is greater than 0.4V, and consider gray inversion occurring at 0.35V~0.45V.

* * * * *